US010335327B2

(12) United States Patent
Kelly et al.

(10) Patent No.: US 10,335,327 B2
(45) Date of Patent: Jul. 2, 2019

(54) SPINE BOARD

(71) Applicants: Alyssa M. Kelly, Oak Park, IL (US); Marlene L. Bokholdt, Downers Grove, IL (US)

(72) Inventors: Alyssa M. Kelly, Oak Park, IL (US); Marlene L. Bokholdt, Downers Grove, IL (US)

( * ) Notice: Subject to any disclaimer, the term of this patent is extended or adjusted under 35 U.S.C. 154(b) by 388 days.

(21) Appl. No.: 14/990,901

(22) Filed: Jan. 8, 2016

(65) Prior Publication Data

US 2016/0228310 A1 Aug. 11, 2016

Related U.S. Application Data

(60) Provisional application No. 62/112,885, filed on Feb. 6, 2015.

(51) Int. Cl.
*A61G 1/04* (2006.01)
*A61G 1/048* (2006.01)

(52) U.S. Cl.
CPC ..... *A61G 1/04* (2013.01); *A61G 1/048* (2013.01); *A61G 2210/50* (2013.01)

(58) Field of Classification Search
CPC ..... A61G 1/04; A61G 1/048; A61G 2210/50
See application file for complete search history.

(56) References Cited

U.S. PATENT DOCUMENTS 3,737,923 A * 6/1973 Prolo ..... A61F 5/05883 128/870
5,109,555 A * 5/1992 Fickler ..... A61G 1/003 5/625
5,113,876 A * 5/1992 Herman ..... A61F 5/05883 24/702
5,211,186 A * 5/1993 Shoemaker ..... A61F 5/05883 128/869
5,626,151 A * 5/1997 Linden ..... A61G 1/00 128/897
5,839,136 A * 11/1998 Vance ..... A61G 1/04 128/878
6,163,902 A * 12/2000 Mollette ..... A61B 6/0421 378/177
6,425,399 B1 * 7/2002 Hoster, Jr. ..... A61F 5/05816 128/869
6,652,140 B1 * 11/2003 Taber ..... A61B 6/04 378/177
6,691,351 B1 * 2/2004 Wharton ..... A61F 5/3776 128/870
2003/0036692 A1 * 2/2003 Landi ..... A61B 6/12 600/407
2006/0253985 A1 * 11/2006 Skripps ..... A61G 13/04 5/622
2014/0318552 A1 * 10/2014 Pinto ..... A61G 1/048 128/876

* cited by examiner

*Primary Examiner* — Eric J Kurilla
*Assistant Examiner* — Amanda L Bailey
(74) *Attorney, Agent, or Firm* — Schiff Hardin LLP

(57) ABSTRACT

A spine board including a backboard wherein at least a portion of the backboard is transparent, and a removable mirror having a reflective surface facing the backboard when the mirror is coupled to an underside of the backboard.

19 Claims, 10 Drawing Sheets

SPINE BOARD

RELATED APPLICATION

This application claims priority to U.S. Provisional Application No. 62/112,885, entitled Spine Board, filed Feb. 6, 2015, the contents of each of which are incorporated herein by reference.

TECHNICAL FIELD

The disclosure relates to a spine board used to immobilize a patient who has experienced trauma, and more specifically, to a spine board comprising a mirror and a backboard, wherein at least a portion of the backboard is transparent and the backboard is coupled thereto to assist examination of the posterior of an immobilized patient.

BACKGROUND

Medical care of a patient involved in a trauma includes visual assessment of the patient's posterior surface. Many such patients present to an emergency department securely immobilized to a spine board. Spine board immobilization prevents movement of the spinal column, reducing the risk of further damaging the spinal cord. However, the posterior surface of the patient must be assessed for other injuries.

Current practice involves a log roll method to view the posterior surface of the patient. Log rolling is a technique for turning a patient whose body must be axially aligned, in which extremities are held close to the patient's sides and the patient is rolled like a log. This practice may be responsible for neurologic deterioration in up to 25% of patients with spinal cord injuries during initial management. Data supports a position against the practice of log rolling, yet no one has offered a better solution, causing significant motion in unstable spines when there is a need for visual assessment of the patient's posterior surface.

A suggested replacement of the log roll being a technique is known as the 6+lift and slide1, with six healthcare providers all lifting the patient straight up while the spine board is slid out from underneath the patient. However, the 6+life and slide1 procedure requires a significant number of healthcare providers, creates a danger to the patient while the spine board is removed, and is labor-intensive. Even when done correctly, the 6+lift and slide1 technique provides no opportunity for the medical staff to visually assess the posterior surface without lifting the patient over their heads.

There remains a need for a spine board that assists a person, such as a doctor, nurse, or emergency medical technician (EMT), to examine a patient while alleviating or eliminating at least (1) the likelihood of aggravating spine trauma, (2) effort required of medical personnel, (3) the difficulty in examining the posterior of a patient while that patient's spine is immobilized.

DETAILED DESCRIPTION

The present disclosure generally relates to a spine board comprising a backboard, wherein at least a portion of the backboard is transparent, and an at least partially removable mirror coupled to an underside of the backboard, wherein a reflective surface of the mirror faces the backboard.

The spine board disclosed herein allows medical personnel to visually assess the posterior surface of a patient for injury while maintaining the patient in spinal immobilization until radiographic evidence rules out spinal cord injury or the spine board as a transport device is no longer necessary. The visual assessment may be made through the backboard or via the mirror reflecting the image of the backboard. Not only will this eliminate or greatly reduce further injury during initial management, but will allow for visual assessment of the posterior surface of the patient.

Figure 1A:
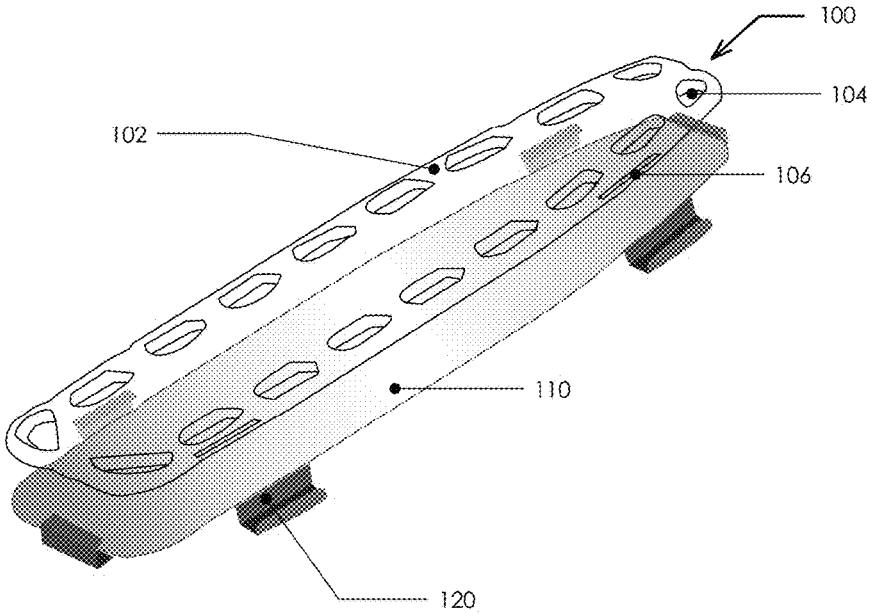
FIG. 1A illustrates a perspective view of a spine board in accordance with one embodiment.
Figure 1B:
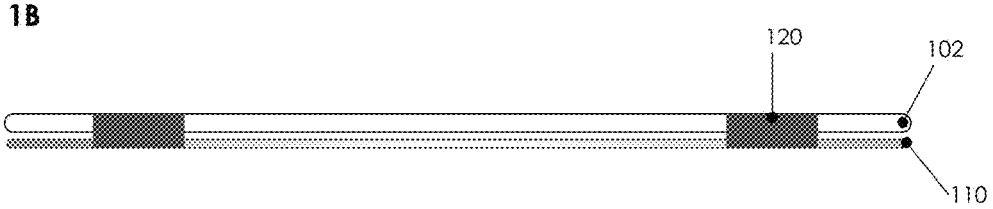
FIG. 1B illustrates a side view of the spine board of FIG. 1A.

FIG. 1A illustrates a perspective view of a spine board 100 in accordance with an embodiment. FIG. 1B illustrates a side view of the spine board 100 of FIG. 1A.

The spine board 100 comprises a backboard 102 and a detachable mirror 110 coupled to the underside of the backboard 102, as shown in FIG. 1B. The backboard 102 may have a portion that is transparent, for example, where a center of the backboard 102 is transparent and a boarder is opaque. Alternatively, the backboard 102 may be fully transparent. A reflective surface of the mirror 110 faces the backboard. The mirror 110 may be coupled at any one or more of the sides of the backboard 102. When not in use the mirror 110 may be substantially flush with the underside of the backboard 102.

The backboard 102 may comprise any transparent, and preferably also radiolucent, material such as a plastic including but not limited to acrylic, amino resin, any cellulosic, polyimide, polyester, polyolefin, and styrene. The backboard 102 may be manufactured to any required size and shape specifications. The thickness of the backboard may be determined based on that necessary to support a patient to a weight of, for example, 100 pounds for a child or 500 pounds for an adult. The backboard 102 may have handholds 104 formed at one or more places near the perimeter of the backboard 102 for people, such as medical personnel, to grip the spine board 100 and move the spine board 100 and any patient located thereon. The handholds 104 may be formed by holes, cavities, textured surfaces or other means, as are known in the art, to improve grip on the backboard 102.

The mirror 110 may be comprised of a plastic material, such as acrylic or Plexiglas, and can be manufactured to the required size and shape specifications of the backboard 102. The mirror 110 may also be made of any material with a reflective surface, including treated glass, metal, or a composite material, and may be flat, convex, or concave. The mirror 110 material may be made of a radiolucent material, such as silvered plastic. The thickness of the mirror 110 may be determined based on the size and shape to fit flush or within the perimeter of the backboard 102. The mirror 110 is not intended to support the weight of the patient.

Figure 1C:
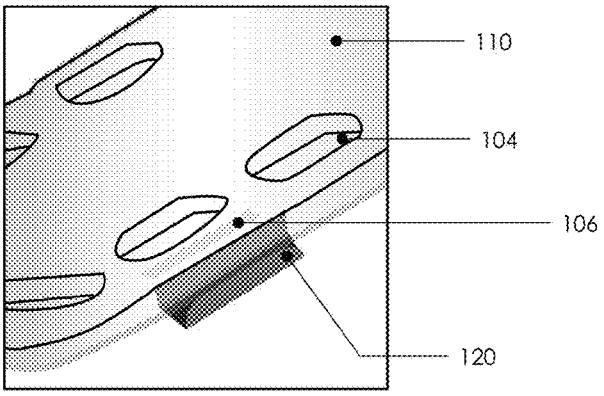
FIG. 1C illustrates a perspective view of an open clamp of the spine board of FIG. 1A.

The mirror 110 may be coupled to the backboard 102 using any of a number of coupling devices. One such coupling device is a clamp 120, as shown in FIGS. 1A-1C. A clamp 120 allows users, such as medical personnel, to open the clamp 120, as shown in FIG. 1C, and release the mirror 110 from the backboard 102 when the backboard 102 is elevated, as shown in FIG. 1A. This allows for visualization of the underside of the backboard 102 and thus the posterior surface of the patient. The mirror 110 may be completely or partially removed, including allowing the backboard 102 to support the patient when radiolucency is required. The clamp 120 may also mate with an indentation in the backboard 106 to further secure the mirror 110 to the backboard 102.

FIG. 1A shows six clamps 120—one at the head portion of the spine board 100, one at the foot portion, and two on each of the two sides of the spine board 100. The disclosure is not limited in this regard. There may be any number of clamps 120 located at any position around the perimeter of the spine board 100 as suitable for the intended purpose. Also, the clamps 120 may be made of any material, such as plastic including radiolucent plastic, metal, or composite materials. The clamps 120 may affix the mirror 110 to the backboard 102 using any means known in the art. In another embodiment, the clamps 120 may have multiple flanges or tabs to allow the mirror 110 to be coupled to the backboard 102 at angles other than parallel to the backboard 102, or at variable distances from the backboard 102.

Figure 2A:
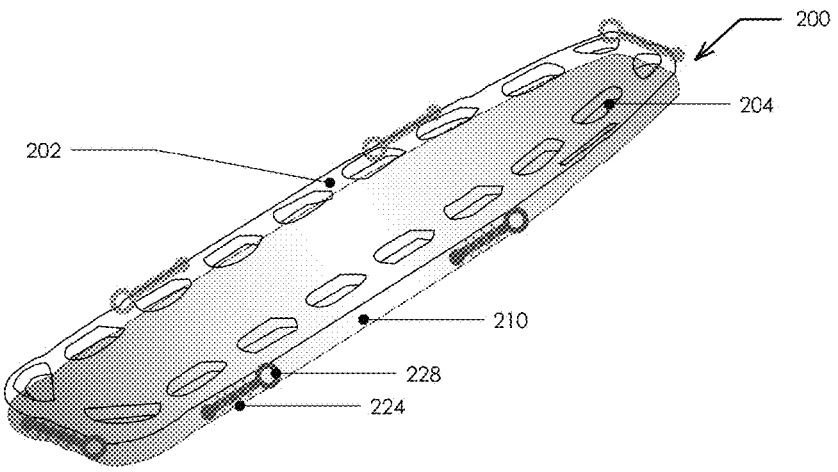
FIG. 2A illustrates a perspective view of a spine board in accordance with another embodiment.
Figure 2B:
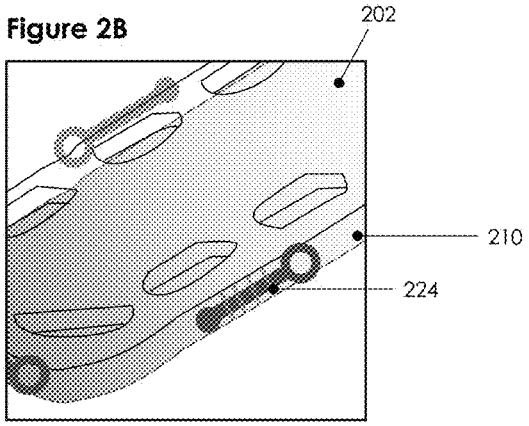
FIG. 2B illustrates a perspective view of a hinge with pull pin as a coupling device of the spine board of FIG. 2A.
Figure 2C:
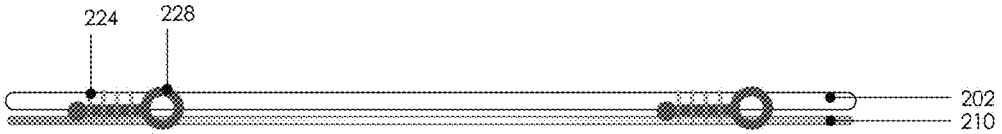
FIG. 2C illustrates a side view of the spine board of FIG. 2A with the pull pin within the hinge.
Figure 2D:
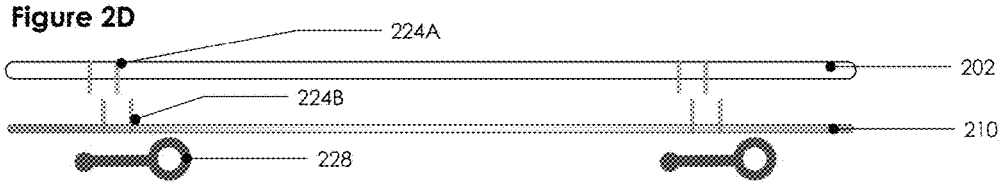
FIG. 2D illustrates a side view of the spine board of FIG. 2A with the pull pin removed from the hinge.

FIG. 2A illustrates a perspective view of a spine board 200 in accordance with another embodiment. FIG. 2B illustrates a perspective view of a hinge assembly 220 with hinge 224 and pull pin 228 as a coupling device of the spine board 200 of FIG. 2A. FIG. 2C illustrates a side view of the spine board 200 of FIG. 2A with the pull pin 228 within the hinge 224. FIG. 2D illustrates a side view of the spine board 200 of FIG. 2A with the pull pin 228 removed from the hinge 224.

FIG. 2A shows six hinge assemblies 220—one at the head portion of the spine board 200, one at the foot portion, and two on each of the two sides of the spine board 200. The disclosure is not limited in this regard. There may be any number of hinge assemblies at any position around the perimeter of the spine board 200 as suitable for the intended purpose. Also, the hinges 224 and pull pins 228 may be made of any material, such as plastic including radiolucent plastic, metal, or composite materials. Any portion of the hinge 224 or pull pin 228 that may remain on the backboard 202 is preferably radiolucent.

Removal of the pull pin 228 from the hinge 224 disengages halves of the hinges 224A, 224B and thereby at that position decouples the mirror 210 from the backboard 202, as shown in FIG. 2D. If the pull pins 228 are left in the hinges 224 of only one side of the backboard 202, the mirror 210 may be pivoted away from the underside of the backboard 202 to, for example, approximately a 60 degree angle to permit a person, such as a doctor, nurse, or EMT, to view in the mirror 210 the underside of the backboard 202 and examine the patient with the backboard 202 requiring only a slight elevation. Alternatively, all of the pull pins 228 may be removed so that the mirror 210 may be completely detached from the backboard 202 to allow the patient to remain immobilized on the spine board 200 during medical imaging (e.g., x-ray or MRI) or other tests or procedures. As described in other embodiments, handholds 204 may also be formed on the backboard 202 by holes, cavities, textured surfaces or other known means to improve grip on the backboard 202.

Figure 3A:
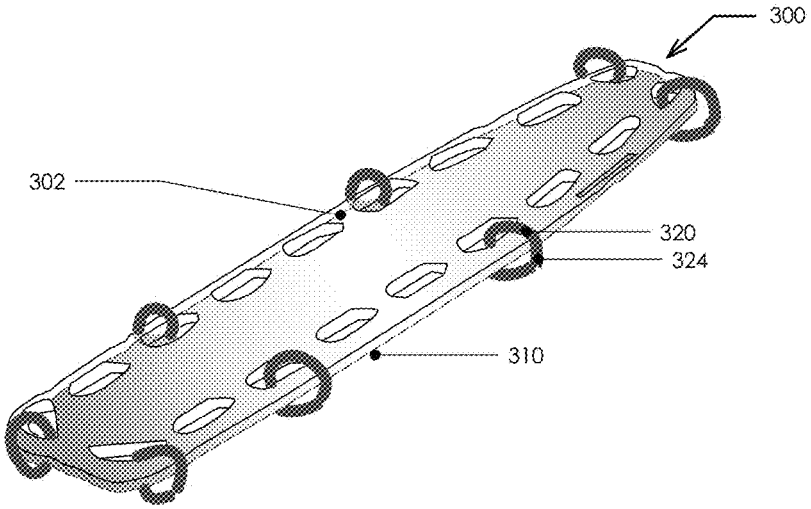
FIG. 3A illustrates a perspective view of a spine board in accordance with another embodiment.
Figure 3B:
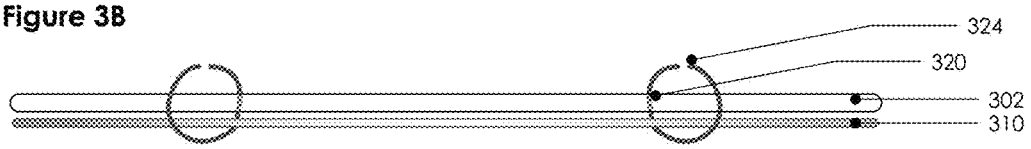
FIG. 3B illustrates a side view of the spine board of FIG. 3A with a strap with snap connection as a coupling device.
Figure 3C:
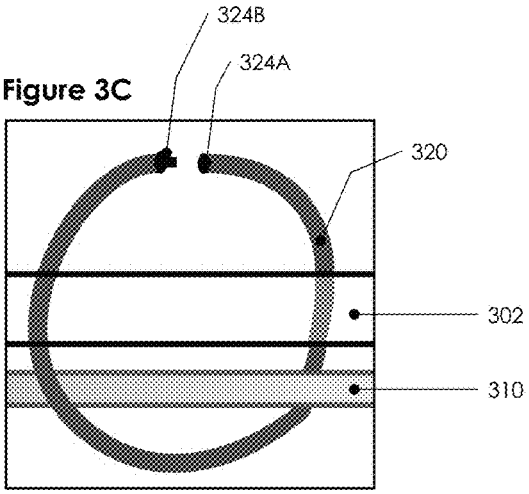
FIG. 3C illustrates a side view of the strap with snap connection as a coupling device of the spine board of FIG. 3A.

FIG. 3A illustrates a perspective view of a spine board 300 in accordance with another embodiment. FIG. 3B illustrates a side view of the spine board 300 of FIG. 3A with the strap 320 with snap connection 324 as a coupling device. FIG. 3C illustrates a side view of the strap 320 with snap connection as a coupling device of the spine board 300 of FIG. 3A.

Straps 320 with snaps 324 are placed around the perimeter of the spine board 300 to couple the backboard 302 and mirror 310 together. The straps 320 are unsnapped as needed to allow the mirror 310 to drop away from the backboard 302 to a desired angle or be completely removed.

FIG. 3A shows eight straps 320—two at the head portion of the spine board 300, two at the foot portion, and two on each of the two sides of the spine board 300. The disclosure is not limited in this regard. There may be any number of straps 320 located at any position around the perimeter of the spine board 300 as suitable for the intended purpose. Also, the straps 320 may be made of any material, such as plastic or rope, with the snaps 324 being a material, such as plastic or any other suitable material. FIG. 3B shows a detailed view of a strap 320 and snaps 324 of FIG. 3A. In one embodiment, the snaps 324 mate via a female snap 324A and a male snap 324B. The disclosure is not limited in this regard. Any type of strap or snap fastener may be used in this embodiment. The straps 320 are removed as needed to allow the mirror 310 to drop away from the backboard 302 to a desired angle or completely removed. As described in other embodiments, handholds 304 may also be formed on the backboard 302 by holes, cavities, textured surfaces or other known means to improve grip on the backboard 302.

Figure 4A:
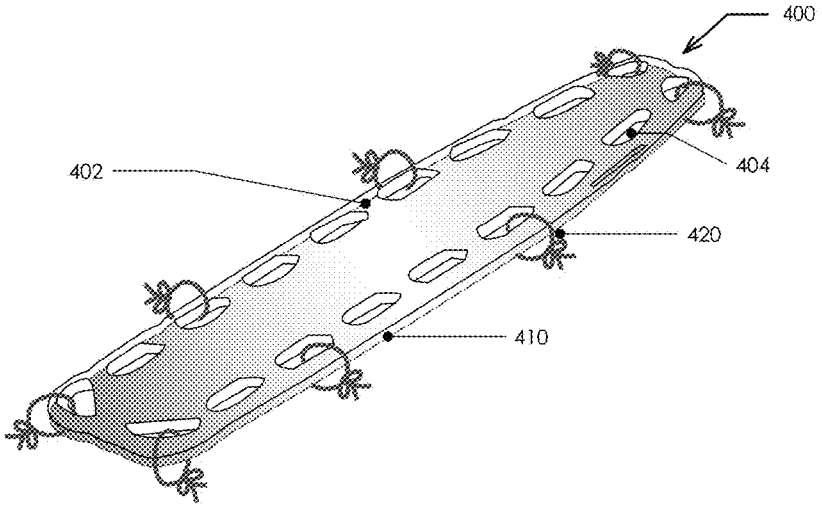
FIG. 4A illustrates a perspective view of a spine board in accordance with another embodiment.
Figure 4B:
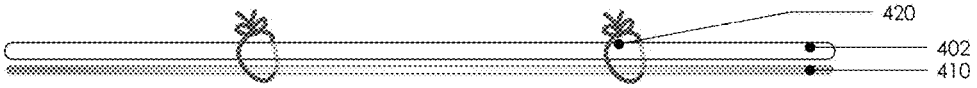
FIG. 4B illustrates a side view of the spine board of FIG. 4A with a tie as a coupling device.
Figure 4C:
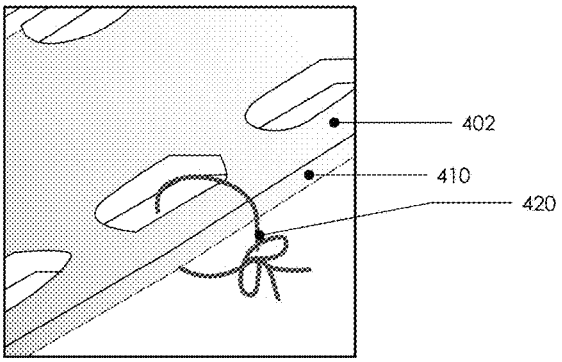
FIG. 4C illustrates a perspective view of the tie as a coupling device of the spine board of FIG. 4A.

FIG. 4A illustrates a perspective view of a spine board 400 in accordance with another embodiment. FIG. 4B illustrates a side view of the spine board 400 of FIG. 4A with a tie 420 as a coupling device. FIG. 4C illustrates a perspective view of the tie 420 as a coupling device of the spine board 400 of FIG. 4A.

Ties 420 are placed around the perimeter of the spine board 400 to couple the backboard 402 and mirror 410 together. The ties 420 are untied as needed to allow the mirror 410 to drop away from the backboard 402 to a desired angle or be completely removed.

FIG. 4A shows eight ties 420—two at the head portion of the spine board 400, two at the foot portion, and two on each of the two sides of the spine board 400. The disclosure is not limited in this regard. There may be any number of ties 420 located at any position around the perimeter of the spine board 400 as suitable for the intended purpose. Also, the ties 420 may be made of any material, such as plastic including radiolucent plastic, metal, composite materials, rope or leather. As described in other embodiments, handholds 404 may also be formed on the backboard 402 by holes, cavities, textured surfaces or other known means to improve grip on the backboard 402.

Figure 5A:
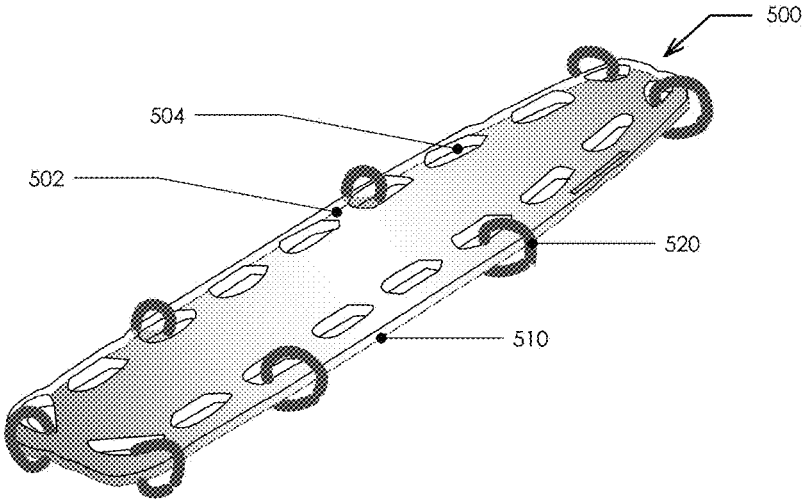
FIG. 5A illustrates a top view of a spine board in accordance with another embodiment.
Figure 5B:
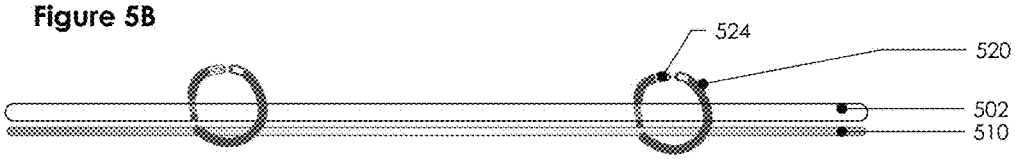
FIG. 5B illustrates a side view of the spine board of FIG. 5A with a strap with a hook and loop fastener as a coupling device.
Figure 5C:
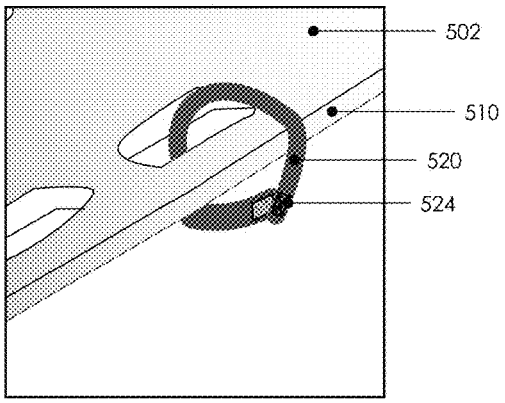
FIG. 5C illustrates a perspective view of the strap as a coupling device of the spine board of FIG. 5A.

FIG. 5A illustrates a perspective view of a spine board 500 in accordance with another embodiment. FIG. 5B illustrates a side view of the spine board 500 of FIG. 5A with a strap 520 with a hook and loop fastener 524 as a coupling device. FIG. 5C illustrates a perspective view of the strap 520 as a coupling device of the spine board 500 of FIG. 5A.

Straps 520 with a hook and loop fastener 524 are placed around the perimeter of the spine board 500 to couple the backboard 502 and mirror 510 together. The straps 520 may be made of any material, such as Velcro®, plastic including radiolucent plastic, metal, composite materials, or rope. The straps 520 are disconnected as needed to allow the mirror 510 to drop away from the backboard 502 to a desired angle or be completely removed.

FIG. 5A shows eight straps 520—two at the head portion of the spine board 500, two at the foot portion, and two on each of the two sides of the spine board 500. The disclosure is not limited in this regard. There may be any number of straps 520 located at any position around the perimeter of the spine board 500 as suitable for the intended purpose. FIG. 5B shows a strap 520 passing through both the backboard 502 and mirror 510, with the hook and loop fastener 524 coupling the strap 520. As described in other embodiments, handholds 504 may also be formed on the backboard 502 by holes, cavities, textured surfaces or other known means to improve grip on the backboard 502.

Figure 6A:
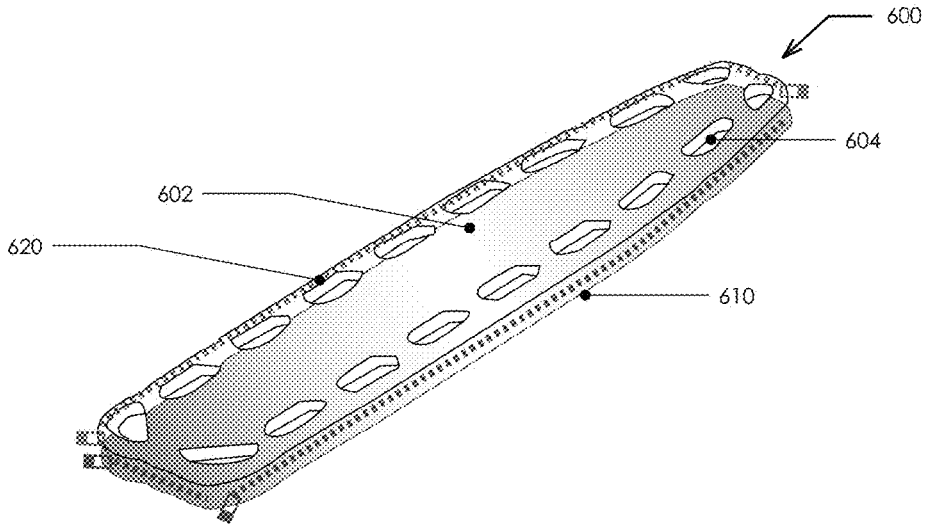
FIG. 6A illustrates a perspective view of a spine board in accordance with another embodiment.
Figure 6B:
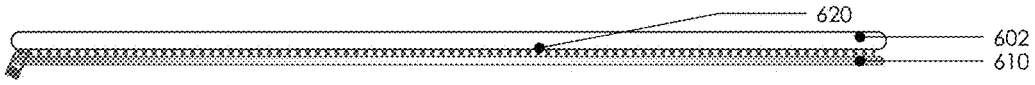
FIG. 6B illustrates a side view of the spine board of FIG. 6A with a zipper as a coupling device.
Figure 6C:
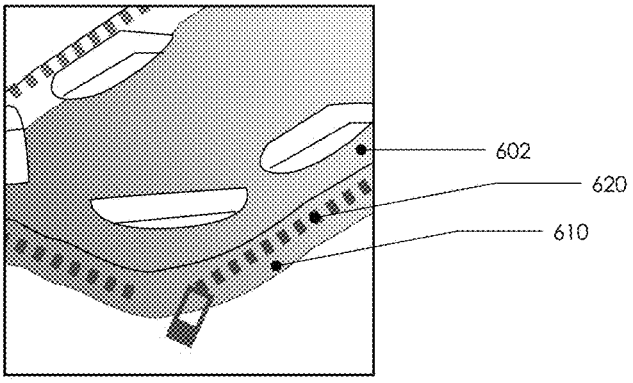
FIG. 6C illustrates a perspective view of the zipper as a coupling device of the spine board of FIG. 6A.

FIG. 6A illustrates a perspective view of a spine board 600 in accordance with another embodiment. FIG. 6B illustrates the spine board 600 of FIG. 6A with a side view of a zipper 620 as a coupling device. FIG. 6C illustrates a perspective view of the zipper 620 as a coupling device of the spine board 600 of FIG. 6A.

Four zippers 620 are placed around the perimeter of the spine board 600 to couple the backboard 602 and mirror 610 together. The zippers 620 are unzipped as needed to allow the mirror 610 to drop away from the backboard 602 to a desired angle or be completely removed.

While four zippers 620 are shown, the disclosure is not limited in this regard. There may be any number of zippers 620 placed around the perimeter as suitable. For example, there may be a single zipper 620 that runs along the entire spine board 600 perimeter. The zippers 620 may be made of any material, such as plastic including radiolucent plastic, metal, or composite materials. As described in other embodiments, handholds 604 may also be formed on the backboard 602 by holes, cavities, textured surfaces or other known means to improve grip on the backboard 602.

Figure 7A:
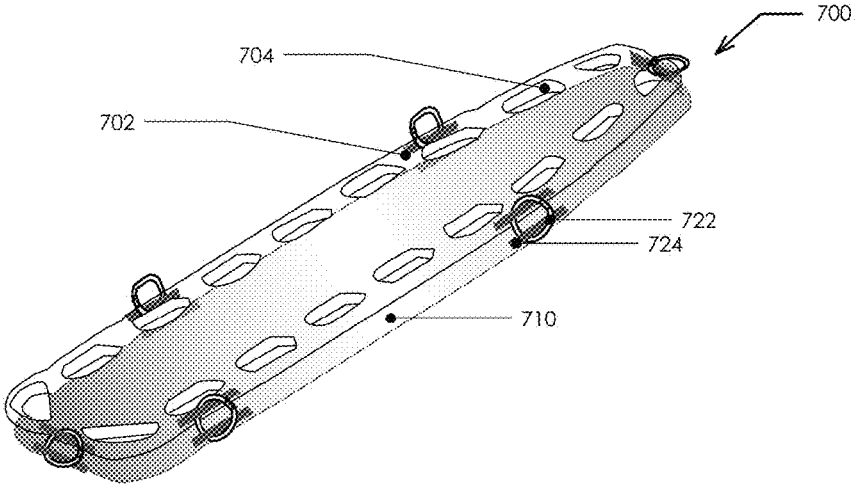
FIG. 7A illustrates a perspective view of a spine board in accordance with another embodiment.
Figure 7B:
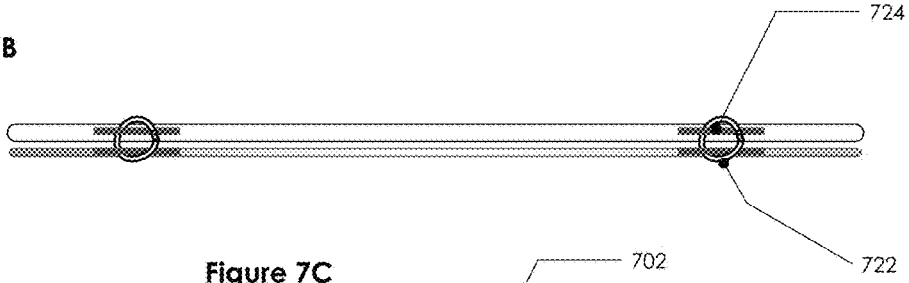
FIG. 7B illustrates a side view of the spine board of FIG. 7A with a strap and hook as a coupling device.
Figure 7C:
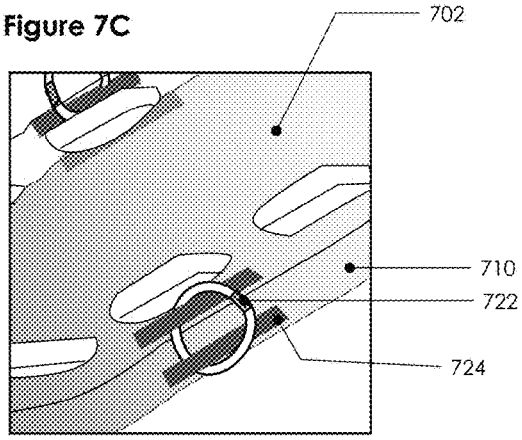
FIG. 7C illustrates a perspective view of the strap and hook as a coupling device of the spine board of FIG. 7A.

FIG. 7A illustrates a perspective view of a spine board 700 in accordance with another embodiment. FIG. 7B illustrates the spine board 700 of FIG. 7A with a side view of a strap 724 and hook 722 as a coupling device. FIG. 7C illustrates a perspective view of the strap 724 and hook 722 as a coupling device of the spine board 700 of FIG. 7A.

Sets of hooks 722 and straps 724 are placed around the perimeter of the spine board 700 to couple the backboard 702 and mirror 710 together. The straps 724 may be detached from the hooks 722 as needed to allow the mirror 710 to drop away from the backboard 702 to a desired angle or be completely removed.

FIG. 7A shows six hook and strap sets 720—one at the head portion of the spine board 700, one at the foot portion, and two on each of the two sides of the spine board 700. The disclosure is not limited in this regard. There may be any number of hook and strap sets 720 located at any position around the perimeter of the spine board 700 as suitable for the intended purpose. FIG. 7B shows an embodiment of a hook 722 and strap 724. Also, the hooks 722 and straps 724 may be made of any material, such as plastic including radiolucent plastic, metal, composite materials, or leather. As described in other embodiments, handholds 704 may also be formed on the backboard 702 by holes, cavities, textured surfaces or other known means to improve grip on the backboard 702.

Figure 8A:
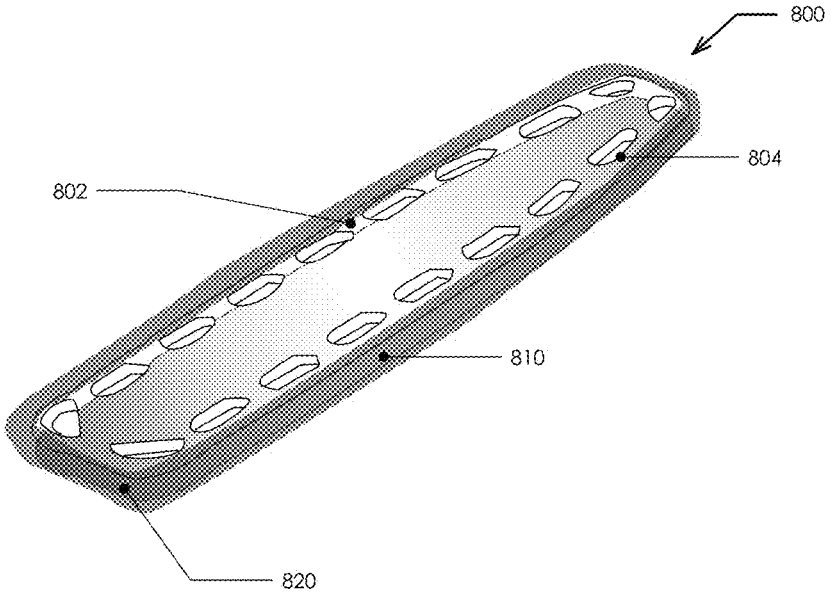
FIG. 8A illustrates a perspective view of a spine board in accordance with another embodiment.
Figure 8B:
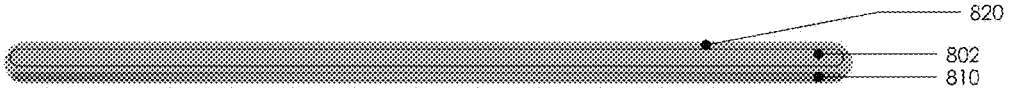
FIG. 8B illustrates a side view of the spine board of FIG. 8A with pliable case as a coupling device.
Figure 8C:
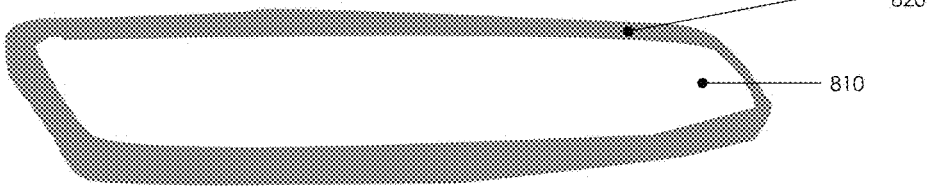
FIG. 8C illustrates a bottom view of the pliable case of the spine board of FIG. 8A.
Figure 8D:
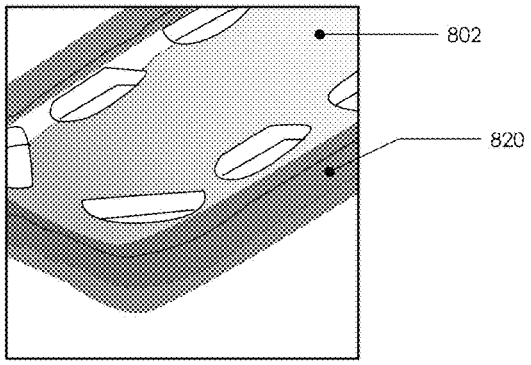
FIG. 8D illustrates a perspective view of the pliable case as a coupling device of the spine board of FIG. 8A.

FIG. 8A illustrates a perspective view of a spine board 800 in accordance with another embodiment. FIG. 8B illustrates a side view of the spine board 800 of FIG. 8A with a pliable case 820 as a coupling device. FIG. 8C illustrates a bottom view of the pliable case 820 of the spine board 800 of FIG. 8A. FIG. 8D illustrates a perspective view of the pliable case 820 as a coupling device of the spine board 800 of FIG. 8A A pliable case 820 comprised of, for example, rubber including radiolucent rubber or plastic including radiolucent plastic, wraps around the perimeter of the backboard 802 and covers the underside of the mirror 810 to couple the mirror 810 to the backboard 802. Sides of the pliable case 820 may be pulled over the edges of all or some of the backboard 802 to allow the mirror 810 to drop away from the backboard 802 to a desired angle or be completely removed. The pliable case 820 may also be made of composite materials, such as radiolucent plastic for the flat portions beneath the backboard 802 and rubber at the edge portions that couple the mirror 810 to the backboard 802, or materials chosen to increase strength or durability of the pliable case 820. As described in other embodiments, handholds 804 may also be formed on the backboard 802 by holes, cavities, textured surfaces or other known means to improve grip on the backboard 802.

Figure 9A:
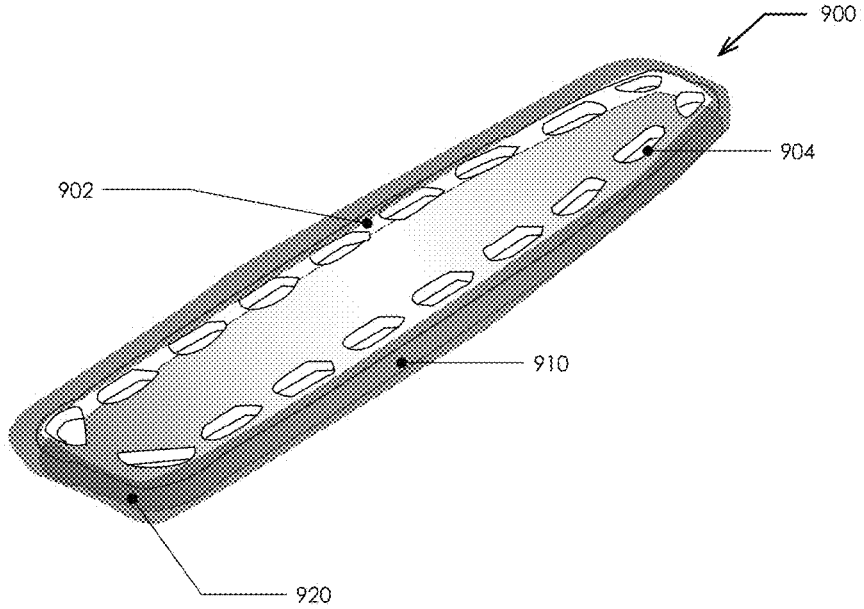
FIG. 9A illustrates a perspective view of a spine board in accordance with another embodiment.
Figure 9B:
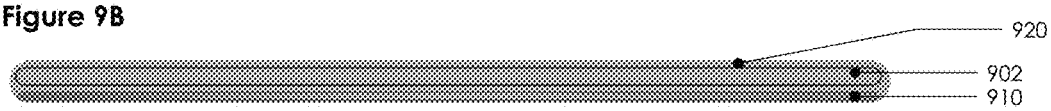
FIG. 9B illustrates a side view of the spine board of FIG. 9A with a pliable bumper as a coupling device.
Figure 9C:
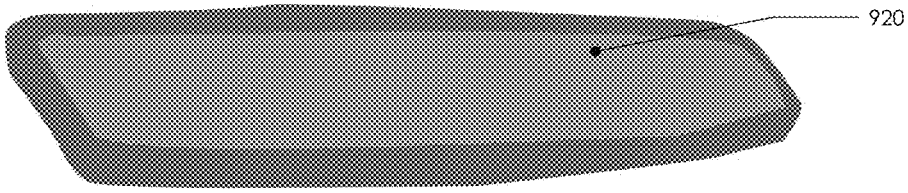
FIG. 9C illustrates a bottom view of the pliable bumper of the spine board of FIG. 9A.
Figure 9D:
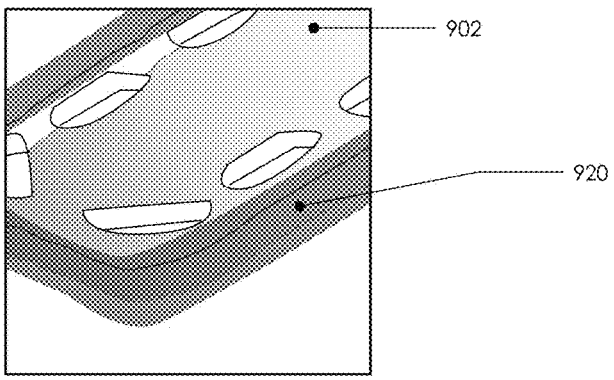
FIG. 9D illustrates a perspective view of the pliable bumper as a coupling device of the spine board of FIG. 9A.

FIG. 9A illustrates a perspective view of a spine board 900 in accordance with another embodiment. FIG. 9B illustrates a side view of the spine board 900 of FIG. 9A with a pliable bumper 920 as a coupling device. FIG. 9C illustrates a bottom view of the pliable bumper 920 of the spine board 900 of FIG. 9A. FIG. 9D illustrates a perspective view of the pliable bumper 920 as a coupling device of the spine board 900 of FIG. 9A.

A pliable bumper 920 comprised of, for example, rubber including radiolucent rubber or plastic including radiolucent plastic, wraps around the perimeter to couple the mirror 910 to the backboard 902. The bumper 920 may be pulled over the edges of the backboard 902 to allow the mirror 910 to drop away from the backboard 902 to a desired angle or completely removed. The pliable case 920 may also be made of composite materials, such as radiolucent plastic for the portions surrounding the perimeter edge, and rubber at the portions that couple the mirror 910 to the backboard 902, or materials chosen to increase strength or durability of the pliable case 920. A difference between the pliable bumper 920 of FIGS. 9A-9C and the pliable case 820 of FIGS. 8A-8C is the pliable bumper 920 of FIGS. 9A-9C does not cover the entire underside of the mirror 910. As described in other embodiments, handholds 904 may also be formed on the backboard 902 by holes, cavities, textured surfaces or other known means to improve grip on the backboard 902.

Figure 10A:
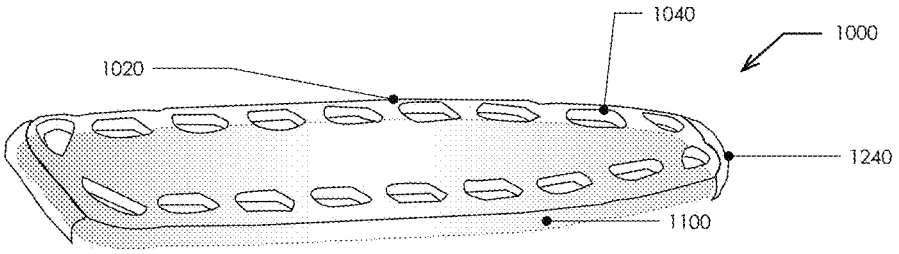
FIG. 10A illustrates a perspective view of a spine board in accordance with another embodiment.
Figure 10B:
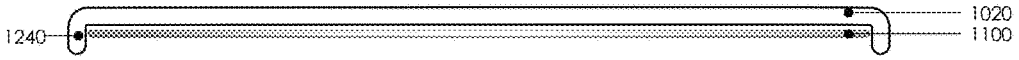
FIG. 10B illustrates a side view of the spine board of FIG. 10A.
Figure 10C:
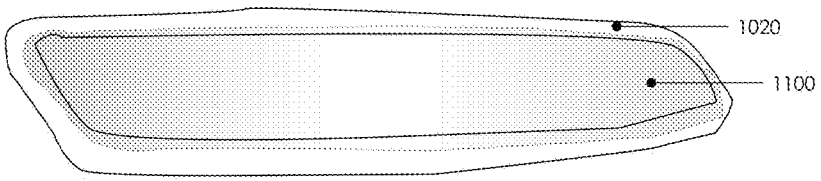
FIG. 10C illustrates a bottom view of the spine board of FIG. 10A.
Figure 10D:
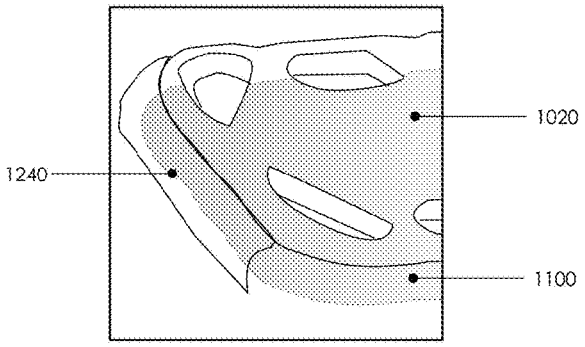
FIG. 10D illustrates a perspective view of the spine board of FIG. 10A.

FIG. 10A illustrates a perspective view of a spine board 1000 in accordance with another embodiment. FIG. 10B illustrates a side view of the spine board 1000 of FIG. 10A. FIG. 10C illustrates a bottom view of the spine board 1000 of FIG. 10A. FIG. 10D illustrates a perspective view of the spine board 1000 of FIG. 10A.

The backboard 1020 has an underside lip 1240 around its underside in which the mirror 1100 may be inset and held therein by snap-fit or using any of the coupling devices as described above. As described in other embodiments, handholds 1040 may also be formed on the backboard 1020 by holes, cavities, textured surfaces or other known means to improve grip on the backboard 1020.

This spine board 1000 as disclosed herein allows medical personnel to visually assess the posterior surfaces of a patient for injury while maintaining the patient in spinal immobilization until radiographic evidence rules out spinal cord injury or the spine board 1000 as a transport device is no longer necessary. Not only will this eliminate or greatly reduce further injury during initial management, but will allow for visual assessment of the posterior surface of the patient.

While the terms "medical personnel" and "patient" have been used throughout the disclosure as a convenient manner of describing the spine board, these terms are not meant to be limiting.

Thus, specific compositions and methods of a spine board with a mirror have been disclosed. It should be apparent, however, to those skilled in the art that many more modifications besides those already described are possible without departing from the inventive concepts herein. The inventive subject matter, therefore, is not to be restricted. Obviously, modifications and alterations will occur to others upon reading and understanding the preceding detailed description. It is intended that the invention be construed as including all such modifications and alterations insofar as they come within the scope of the appended claims or the equivalents thereof.

The invention claimed is:

1. A spine board, comprising: a backboard, wherein at least a portion of the backboard is transparent; and a mirror that is coupled to the backboard via one or more coupling devices, the mirror being substantially the same size as the backboard, the coupling devices facilitating the mirror being at least partially removable from the backboard, and the mirror having a reflective surface facing the backboard when the mirror is coupled to an underside of the backboard, wherein at least partially removing the mirror from the backboard facilitates visual assessment of a posterior surface of a patient occupying the spine board using a reflection, via the mirror, of the posterior surface of the patient through the portion of the backboard that is transparent.

2. The spine board of claim 1, wherein the backboard is radiolucent.

3. The spine board of claim 1, wherein the backboard is comprised of a material selected from the group of materials consisting of acrylic, amino resin, any cellulosic, polyimide, polyester, polyolefin, and styrene.

4. The spine board of claim 1, wherein the mirror is comprised of plastic.

5. The spine board of claim 1, wherein the one or more coupling devices comprises one or more clamps located at the perimeter of the spine board.

6. The spine board of claim 5, wherein the one or more coupling devices comprises a first clamp located at a head perimeter of the spine board, a second clamp located at a foot perimeter of the spine board, third and fourth clamps located on one side perimeter of the spine board, and fifth and sixth clamps located on another side perimeter of the spine board.

7. The spine board of claim 1, wherein the one or more coupling devices comprises one or more hinges with respective pull pins located at the perimeter of the spine board.

8. The spine board of claim 7, wherein the one or more coupling devices comprises a first hinge with a respective pull pin located on one side perimeter of the spine board, and a second hinge with a respective pull pin located on another side perimeter of the spine board, such that if the pull pin of the second hinge is removed, the mirror may pivot away from the underside of the backboard.

9. The spine board of claim 1, wherein the one or more coupling devices comprises one or more straps threaded through holes located near the perimeter of the spine board, and wherein the one or more straps have respective snap connections.

10. The spine board of claim 1, wherein the coupling device comprises one or more ties threaded through holes located near the perimeter of the spine board.

11. The spine board of claim 1, wherein the coupling device comprises one or more straps threaded through holes located near the perimeter of the spine board, and wherein the one or more straps have respective hook and loop fasteners.

12. The spine board of claim 1, wherein the one or more coupling devices comprises one or more zippers located around the perimeter of the spine board.

13. The spine board of claim 1, wherein the one or more coupling devices comprises one or more hook and strap sets located on the perimeter of the spine board.

14. The spine board of claim 1, wherein the one or more coupling devices comprises a pliable case configured to cover the mirror and wrap around the perimeter of the backboard.

15. The spine board of claim 1, wherein the one or more coupling devices comprises a pliable bumper configured to wrap around the perimeter of the spine board.

16. A spine board comprising: a backboard, wherein at least a portion of the backboard is transparent; and a mirror that is at least partially removable from the backboard via a coupling means, the mirror being substantially the same size as the backboard and having a reflective surface facing the backboard, wherein the coupling means removably couples the mirror to the backboard, and wherein at least partially removing the mirror from the backboard facilitates visual assessment of a posterior surface of a patient occupying the spine board using a reflection, via the mirror, of the posterior surface of the patient through the portion of the backboard that is transparent.

17. The spine board of claim 16, wherein the coupling means includes a lip located around a perimeter of the backboard that allows the mirror to be set therein.

18. The spine board of claim 17, wherein the lip allows the mirror to be coupled to the backboard by snap-fit.

19. The spine board of claim 16, wherein at least partially removing the mirror from the backboard includes pivoting a portion of the mirror from the backboard to form an angle between the mirror and the backboard to facilitate the visual assessment of the posterior surface of a patient occupying the spine board using the mirror.

* * * * *